United States Patent [19]

Bulman

[11] Patent Number: 4,928,571

[45] Date of Patent: May 29, 1990

[54] LIQUID PROPELLANT GUN

[75] Inventor: Melvin J. Bulman, Shelburne, Vt.

[73] Assignee: General Electric Company, Pittsfield, Mass.

[21] Appl. No.: 403,275

[22] Filed: Aug. 10, 1989

Related U.S. Application Data

[63] Continuation of Ser. No. 840,074, Oct. 6, 1977, abandoned.

[51] Int. Cl.[5] ..... F41F 1/04

[52] U.S. Cl. ..... 89/7; 89/8

[58] Field of Search ..... 89/7, 8

[56] References Cited

U.S. PATENT DOCUMENTS

| | | | |
|---|---|---|---|
| 2,922,341 | 1/1960 | Treat | 89/7 |
| 2,981,153 | 4/1961 | Wilson et al. | 89/7 |
| 2,986,072 | 5/1961 | Hudson | 89/7 |
| 3,138,990 | 6/1964 | Jukes et al. | 89/7 |
| 3,690,255 | 9/1972 | Vass et al. | 102/440 |
| 3,763,739 | 10/1973 | Tassie | 89/7 |
| 4,023,463 | 5/1977 | Tassie | 89/7 |
| 4,033,224 | 7/1977 | Holtrop | 89/7 |
| 4,069,739 | 1/1978 | Ashley | 89/7 |
| 4,336,741 | 6/1982 | Baines | 89/7 |

OTHER PUBLICATIONS

Final Report of Nov. 19, 1953–Jan. 31, 1956, Under Contract DA-36-034-ORD-1504RD, Project TSl-4-7-8; by V. C., Barnes, Jr., et al.

Report No. 17-2 of Jun. 15, 1954, Under Contract NOrd-10448, by C. R. Foster, et al.

Final Report of Sep. 1, 1957, Under Contract NOrd 16217, Task 1, by L. C. Elmore, et al.

"Direct Injection Liquid Propellant Gun Technology", by Penn, Campbell and Bulman, CPAI Pub. 280, Jun. 1977, pp. 257–303.

*Primary Examiner*—David H. Brown

*Attorney, Agent, or Firm*—Bailin L. Kuch

[57] ABSTRACT

A liquid propellant gun system has an annular differential piston journaled for telescopic movement with respect to an annular control valve and to the chamber of the firing bore; uses the piston, the valve and the projectile as valve means for controlling the injection of liquid propellant into the combustion chamber of the gun system; uses a displacement type control means to limit the rate of the loading of liquid propellant and to provide a positive evacuation of misfired liquid propellant from the combustion chamber; and incorporates a vernier control circuit to give direct control over the performance of the gun.

29 Claims, 2 Drawing Sheets

LIQUID PROPELLANT GUN

This is a continuation of co-pending application Ser. No. 05/840,074 filed on 10/06/77, now abandoned.

BACKGROUND OF THE INVENTION

1. Field of the Invention

This invention relates to liquid propellant guns utilizing a differential piston to provide continued or regenerative injection of propellant into the combustion chamber.

2. Prior Art

Liquid propellant guns utilizing differential pistons to pump propellant into the combustion chamber during combustion are now well known. Early work is described in a Final Report of Nov. 19, 1953–Jan. 31, 1956 under contract DA-36-034-ORD-1504RD, Project TS1-47-8 V. M. Barnes, Jr. et al which apparently in part corresponds to Jukes et al, U.S. Pat. No. 3,138,990, filed Oct. 9, 1961; in a report No. 17-2 of June 15, 1954 under contract NOrd-10448 by C. R. Foster et al; and in a Final Report of Sept, 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr. et al, U.S. Pat. No. 2,981,153, filed Nov. 14, 1952; C. M. Hudson, U.S. Pat. No. 2,986,072, filed Nov. 19, 1952; E. J. Vass et al, U.S. Pat. No. 3,690,255, filed Oct. 1, 1970; and D. P. Tassie, U.S. Pat. No. 4,023,463, filed June 10, 1976. A round of ammunition having a differential piston which is coaxial with the firing bore is shown by E. Ashley in Ser. No. 469,507, filed May 13, 1974, now abandoned. Reference may also be made to an article "Direct Injection Liquid Propellant Gun Technology" by Penn, Campbell and Bulman, CPAI Publication 280, June 1977, pp 257–303, which shows a differential piston which is coaxial with a firing bore in a gun.

RELATED APPLICATIONS

Details of this particular round of ammunition disclosed, but not claimed in this application, are claimed in the application of R. A. Algera, Ser. No. 840,075, filed Oct. 6, 1977. Details of this gun disclosed, but not claimed in this application, are claimed in the application of R. E. Mayer, Ser. No. 840,104, filed Oct. 6, 1977.

SUMMARY OF THE INVENTION

An object of this invention is the provision of a liquid propellant gun system having a differential piston which is coaxial with the firing bore wherein the projectile may be fed longitudinally, forwardly into the chamber of the firing bore.

Another object is the provision of such a gun system wherein the timing of the loading of the liquid propellant and the timing of the loading of the projectile are substantially mutually independent.

Yet another object is the provision of such a gun system wherein in the case of a misfire, extraction of the projectile and evacuation of the liquid propellant are performed during the normal gun cycle.

A feature of this invention is the provision of a liquid propellant gun system having an annular differential piston journaled for telescopic movement with respect to an annular control valve and to the chamber of the firing bore.

Another feature of this invention is the use of the piston, the valve and the projectile as valve means for controlling the injection of liquid propellant into the combustion chamber of the gun system.

Still another feature of this invention is the use of a displacement type control means to limit the rate of the loading of liquid propellant and to provide a positive evacuation of misfired liquid propellant from the combustion chamber.

Yet another feature of this invention is the incorporation of a vernier control circuit to give direct control over the performance of the gun.

DESCRIPTION OF THE INVENTION

Figure 1:
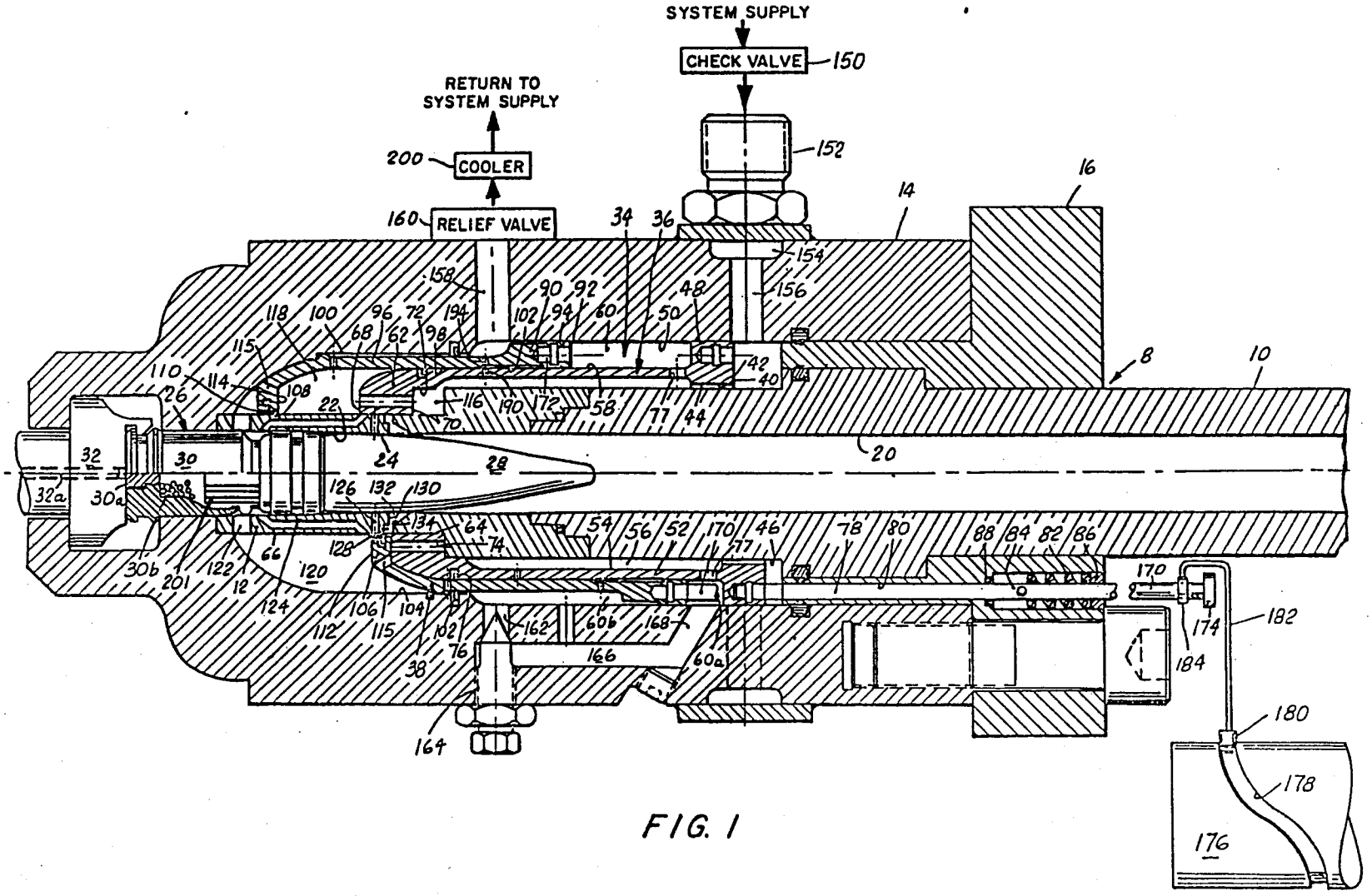
FIG. 1 is a view in elevation, in longitudinal cross-section, of a gun system embodying this invention. The lower half of the view shows the assembly prior to filling with liquid propellant, while the upper half shows the assembly after filling and prior to firing.

The gun system includes a gun barrel assembly 8 which consists of a forward barrel 10 which is fixed to a barrel extension 12 within a housing 14 by a cover 16. The barrel assembly has a rifled firing bore 20, a projectile receiving chamber 22 which also serves as a combustion chamber, and an intermediate forcing cone 24. A round of ammunition 26 comprising a projectile 28 crimped to a stub case 30 having a percussion primer **30*a* and a booster charge 30*b* is chambered, locked and extracted by a conventional bolt 32**, or, in a large caliber gun, a breech block.

The barrel assembly in conjunction with the housing 14 define a substantially hollow cylindrical cavity 34 in which are telescopically disposed a substantially hollow cylindrical valve 36 and a substantially hollow cylindrical piston 38.

The valve 36 includes a forward annular portion 40 having an inner wall surface 42 providing an annular gap or passageway 44 adjacent the outer wall surface 46 of the barrel and having an outer wall surface 48 journaled on the inner wall surface 50 of the housing and substantially sealed thereto. The annular portion 40 is integral with an intermediate tubular portion 52 having an inner wall surface 54 providing an annular cavity 56 adjacent the outer wall surface 46, and having an outer wall surface 58 providing an annular cavity 60 adjacent the inner wall surface 50 of the housing. The intermediate portion 52 is integral with an aft annular portion 62 having an inner wall surface 64 journaled on the outer wall surface 66 of the barrel extension and substantially sealed thereto, a transverse aft surface 68, a transverse forward surface 70, an inner annular surface 72, a plurality of longitudinal bores or passageways 74 extending between the surfaces 68 and 70, and a ring seal 76 disposed in an annular groove in the outer wall surface 58. A plurality of radial bores 77 are also provided in the intermediate portion 52 to provide a passageway between the inner cavity 56 and the outer cavity 60. Two rods 78 have their aft ends respectively fixed to the forward annular portion 40, and pass through bores 80 in the housing. The rods are each biased aftwardly by a respective helical compression spring 82 captured between a cross pin 84 on the rod and plug 86 in the housing. Each rod may have a respective seal 88.

The piston 38 includes a forward annular portion 90 having an inner wall surface 92 journaled on the surface 58 of the valve and an outer wall surface 94 journaled on the surface 50 of the housing. The annular portion 90 is integral with an intermediate tubular portion 96 having an inner surface 98 bearing against the ring seal 76 in the valve, and an outer surface 100 bearing against a high performance ring seal 102 disposed in an annular groove in the inner surface 104 of the housing. The intermediate portion 96 is integral with an aft annular portion 106 having an inner wall surface 108 in which is mounted an L type ring seal 110 which is journaled on and seals to the outer surface 66 of the barrel extension, a transverse aft surface 112, a transverse forward surface 114, and a plurality of bores or passageways 115 extending between the surfaces 112 and 114. It will be seen that the effective cross-sectional area of the forward surface 114 is less than the effective cross-sectional area of the aft surface 112, providing the piston sleeve 38 with a differential piston action.

The barrel extension 12, the valve 36 and the piston 38, depending on their mutual positioning, may be considered to define a liquid propellant supply cavity 116, a pumping cavity 118, and an additional combustion cavity 120. The barrel extension 12 has a first plurality of radial passageways 122 disposed aft in an annular row, serving as passageways between the combustion chamber 120 and the projectile chamber 22; a second plurality of passageways 124, a third plurality of passageways 126 and a fourth plurality of passageways 128, each plurality disposed in a respective annular row and serving as passageways between the pumping chamber 118 and the projectile chamber 22. The passageways 128 comprise a plurality of radial bores terminating in a common annular groove 130 providing a shoulder 132 partially obstructing each bore in the aft firing bore direction and a surface 134 at an obtuse angle to the surface of the firing bore in the forward direction.

A check valve 150 is coupled to an inlet 152 in the housing 14 which leads to an annular passageway 154 in the housing, from which a plurality of radial bores 156 lead to and through the forward portion of the surface 50. A radial bore 158 leads through and from the surface 50 aft of the annulus 90 of the piston 38 to a relief valve 160. A radial bore 162 aft of the annulus 90 of the piston 38, in which is seated a needle valve 164, communicates with a bore 166, which communicates with a bore 168 which leads to and through the surface 50 forward of the annulus 90.

Two rods 170 and 172 have their aft ends respectively fixed to the forward annular portion 90 of the piston 38, and pass through bores with seals in the housing which are similar to the bores 80. The forward ends of the rods respectively terminate in an enlargement 174. A drum cam 176, such as in shown in U.S. Pat. No. 3,763,739 filed June 1, 1971, by D. P. Tassie, has a helical control track 178 in which rides a cam follower 180 which has an arm 182 which terminates in a rod follower 184. The rods are free to move forwardly free of the follower 180, but are controlled in their movement aftwardly by the cam track 178 via the followers 180 and 184. The cam track 178 is also able to pull the rods forwardly via the followers 180 and 184. The enlargement 174 and the rod follower 184 serve as a clutch, i.e. a coupling used to connect and disconnect a driving and driven part of a mechanism.

OPERATION

Figure 2:
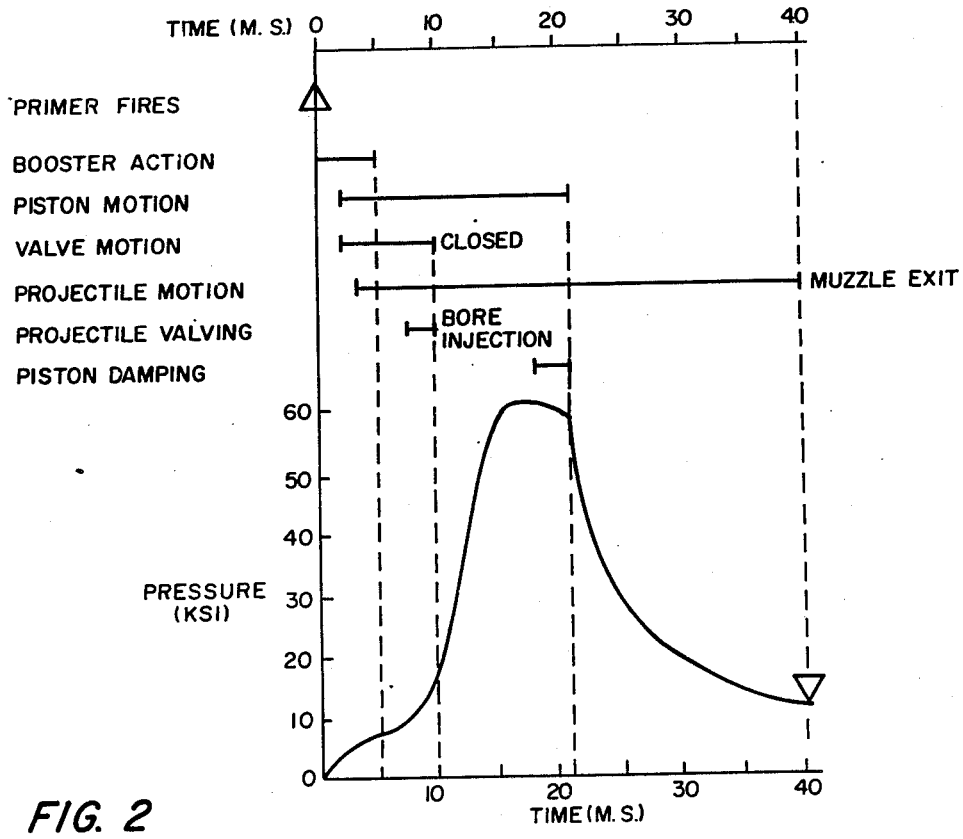
FIG. 2 is a chart of cycle of operation of the gun system of FIG. 1.

An exemplary gun cycle is shown in FIG. 2.

After firing is completed, the piston 38 and the valve 36 are in their nested, forwardmost positions, as shown in the lower half of FIG. 1. The surface 48 of the valve annulus 40 serves to close the supply bores 156. After pressure in the combustion chamber is adequately vented and when allowed by the cam 176, the springs 82 biasing the rods 78 shift the valve aft to the position shown in the upper half of FIG. 1. The piston is still nested on the valve. As the valve is shifted aft, the supply bores 156 are uncovered by the surface 48, admitting liquid propellant forward of the annulus 40. The propellant flows through the annular passageway 44 into the cavity 56, through the passageways 77 into the cavity 60, into the supply cavity 116 and into the bores 74. When allowed by the cam 76, the pressure of the propellant unnests the piston aftwardly from the valve to define the pumping cavity 118 into which propellant flows from the bores 74. In the aftmost position of the valve, the surface 64 closes the inlet ends of all three pluralities of bores 124, 126 and 128. Thus no propellant can enter these bores and pass to the projectile receiving and combustion chamber 22. Various bores, typically 190, are provided to insure that the running surfaces between the valve and the piston 98 and 58 are lubricated with propellant. Additional bores, typically 194, are provided to assist in purging air from the system.

The round of ammunition 26 is inserted into the projectile chamber 22 by the bolt 32. The bolt is locked.

The firing pin **32*a* of the bolt 32 percusses the primer 30*a*, the primer fires and ignites the booster charge 30*b*. The combustion gas from the booster charge unseats the projectile from its case forwardly. Combustion gas passes through the bores 122 into the additional combustion chamber 120 and applies force against the aft face 112 of the piston, moving the piston forwardly to commence compression of the liquid propellant in the pumping chamber 118. Some propellant passes through the bores 115 into the additional combustion chamber 120 chamber and is ignited. The valve 36 is moved forwardly to commence reducing the volume of the supply cavity 116. When the forward corner of the surface 72 of the valve reaches the aft corner of the surface 46 of the barrel extent ion, the supply cavity 116 becomes a closed cavity whose only outlet is the bores 74, thereby providing a dash-pot action to cushion the nesting of the valve onto the barrel extension. While the projectile is in the projectile chamber 22 it closes the outlets of the plurality of bores 128 and the plurality of bores 126 and 124. As the valve moves forward it first uncovers the inlets of the bores 124 which permits the passage of liquid propellant from the pumping chamber 118 into the aft portion of the projectile chamber where it is ignited by the combustion gas from the booster charge, to increase the acceleration of the projectile over what has been provided by the booster charge per se and the propellant from the bores 115. When the valve is partially closed onto the barrel extension it uncovers the inlets to the bores 126, and when it is fully closed, it uncovers the inlets to the bores 128. When the projectiles as moved forwardly down the firing bore 20 to uncover the outlets of the bores 126 and 128, additional liquid propellant is injected through these bores into the projectile chamber 22 and ignited. As liquid propellant passes out of the bores 128 into the annulus 130 it is deflected by the bulk combustion gas flow forwardly through the projectile chamber to provide a continuously replenished film or tube of liquid on the surface 134 which extends forwardly (down-stream) along the surface of the firing bore 20. This tube of liquid propellant encircles and feeds a tubular combustion zone. The tube of film insulates the adjacent surface of the firing bore from the heat of the combustion zone. As the piston 38 closes forwardly on the valve 36 it also is a closed cavity whose only outlets are the bores 115, 124, 126 and 128**, thereby providing a dash-pot action to cushion the nesting of the piston onto the valve.

As the piston moves forwardly during the firing subcycle, the annular portion 90 pushed against liquid propellant ahead of it in the forward portion 60*a* of the cavity 60. This forward portion serves as a closed cavity whose only outlets are the bores 77 and the bore 168. The bores 77 lead only to the cavity 56, which when the valve sleeve is in its forward nested position, is itself a fully closed cavity. The bore 168 communicates via the bore 166, the needle valve 164 and the bore 162 with the aft portion 60*b* of the cavity 60. The aft portion increases in volume as the forward portion decreases in volume. The rate of transfer between the portions is controlled by the needle valve. Thus, the cavity 60 with the needle valve circuit serves as an injection rate control system yielding direct performance adjustment. Any surplus liquid propellant developed as the difference between the volumes of the forward and the aft portions of the cavity 60 may be discharged via the pressure relief valve 160. Such discharged liquid propellant may be either dumped and lost, or passed through a cooling system 200, e.g. a radiator, and then returned to the liquid propellant supply system. A higher than conventional ratio of injection pressure to chamber pressure, e.g. 1.4 to 1, rather than 1.2 to 1, may be provided to permit a high initial acceleration until the valve sleeve closes and the needle valve circuit assumes control.

It will be noted that the cam track 178 serves to control the filling subcycle by its restraint of the aftward movement of the piston 38. It does not control or hinder the forward movement of the piston. However, should a misfire occur, such that the piston does not move forwardly during the time interval alloted to the firing cycle, then the cam track 178, via the followers 184 engaging the rod enlargements 174, will shift the piston forwardly. As the piston moves forwardly, the liquid propellant in the pumping cavity 118 is forced through the bores 74 into the supply cavity 116 and the cavity 56, through the bores 77 into the cavity 60, through the needle valve circuit and out through the pressure relief valve 160.

The booster 30*b* is made powerful enough, so that, if ignited, it will generate a volume of combustion gas adequate to force the projectile forwardly through the length of the firing bore and out of the gun.

After the completion of the firing cycle, the bolt is unlocked and extracts the cartridge case. If a misfire has occurred such that the primer did not ignite the booster, the projectile will be extracted with the cartridge case. If the booster did ignite, only the cartridge case will remain with the bolt for extraction.

It will be noted that the cartridge case thus serves three functions. It provides a replaceable seal to close the aft end of the projectile chamber. It also provides a mechanism for extracting the projectile in the event of a misfire. In addition it provides a replaceable ignition system unavailable in other liquid propellant systems.

The aft end of the projectile which is received into the neck of the cartridge case may be provided with a plurality of longitudinal grooves 201 whose forward ends are closed by the forwardmost portion of the neck of the case. These grooves serve as passageways for booster combustion gas, deflecting open the case neck closures, to pass into the projectile cavity and through the bores 122 to apply force to the aft face of the piston.

The injection bores 115 through the piston may be omitted and all injection provided through the bores 124, 126 and 128. In this case only the projectile receiving chamber 22 serves as a combustion chamber. The chamber 120 will merely receive combustion gas through the bores 122 to advance the piston sleeve forwardly. In addition bore 124 could be eliminated with all injection provided through bores 126 and 128, or only one of them in which case the primer 30*a* alone or in combination with the booster 30*b* would move the projectile sufficiently to permit injection of the liquid propellant. Furthermore a mechanical device could be used to "jog" the projectile to open a bore or conduit opening into the bore to permit the flow of liquid propellant into the combustion chamber.

What is claimed is:

1. A liquid propellant gun comprising:

a housing having a longitudinally extending first cavity therein;

a gun barrel having a firing bore with a projectile receiving chamber disposed along a longitudinal axis;

said gun barrel being disposed within said housing first cavity and with said housing defining a second closed cavity which is a portion of said first cavity and is of substantially annular, longitudinally extending shape and is coaxial with said barrel longitudinal axis;

a valve sleeve of substantially annular, longitudinally extending shape coaxial with said barrel longitudinal axis and disposed in said second cavity;

a piston sleeve of substantially annular, longitudinally extending shape coaxial with said barrel longitudinal axis and disposed in said second cavity;

said piston sleeve and said valve sleeve being journaled for relative motion with respect to each other and said gun barrel, said valve sleeve and said gun barrel mutually defining a supply chamber of variable volume for liquid propellant, and said piston sleeve and said valve sleeve mutually defining a pumping chamber of variable volume for liquid propellant;

obturating means for closing the aft end of said projectile receiving chamber;

supply means for supplying liquid propellant under pressure;

first conduit means for coupling and decoupling said supply means to said supply chamber;

second conduit means for coupling and decoupling said supply chamber to said pumping chamber; p1 third conduit means for coupling and decoupling said pumping chamber to said projectile receiving chamber;

said valve sleeve, said piston sleeve, said first conduit means, said second conduit means and said third conduit means having a mode of operation such that;

initially said first conduit means, said second conduit means and said third conduit means are each decoupled and said pumping chamber is at its minimum volume, subsequently said first conduit means is coupled and passes liquid propellant to said supply chamber, subsequently said second conduit means is coupled and passes liquid propellant to said pumping chamber, subsequently said pumping chamber is expanded to its maximum volume by inletted liquid propellant, and subsequently said pumping chamber is reduced in volume, and said third conduit means is coupled, injecting liquid propellant into said projectile receiving chamber.

2. A gun according to claim 1 wherein:

said first conduit means includes said valve sleeve, and longitudinal movement of said valve sleeve relative to said gun barrel serves to decouple and couple said supply means to such supply chamber.

3. A gun according to claim 1 wherein:

said second conduit means includes said valve sleeve, and longitudinal movement of said valve sleeve relative to said gun barrel serves to decouple and couple said supply chamber to said pumping chamber.

4. A gun according to claim 1 wherein:

said third conduit means includes said valve sleeve and longitudinal movement of said valve sleeve relative to said gun barrel serves to decouple and couple said pumping chamber to said projectile receiving chamber.

5. A gun according to claim 1 further including:

a projectile disposed in said projectile receiving chamber, and said third conduit means includes said projectile and longitudinal movement of said projectile relative to said projectile receiving chamber serves to decouple and couple said pumping chamber to said projectile receiving chamber.

6. A gun according to claim 1 wherein:

said supply chamber is so constructed and arranged as to undergo a cycle of change of volume from zero to maximum to zero as a function of reciprocation of said valve sleeve, and when said supply chamber passes through a predetermined intermediate volume as it approaches zero, it assumes the characteristic of a dash-pot to decelerate the velocity of said valve sleeve.

7. A gun according to claim 1 wherein: said pumping chamber is so constructed and arranged as to undergo a cycle of change of volume from zero to maximum to zero as a function of reciprocation of said piston sleeve, and as the volume approaches zero, said pumping chamber provides the characteristic of a dash-pot to decelerate the velocity of said piston sleeve.

8. A gun according to claim 1 wherein:

said piston sleeve and said valve sleeve mutually define a first additional cavity; and said piston sleeve and said housing mutually define a second additional cavity; further including control conduit means coupled to and between said first additional cavity and said second additional cavity;

wherein said gun has a cycle or operation including a liquid propellant injection subcycle during which liquid propellant is admitted into said first and second additional cavities, and said first additional cavity has a progressive increase in its volume and said second additional cavity has a progressive decreases in its volume, and a liquid propellant combustion subcycle during which said first additional cavity has a progressive decrease in its volume and said second additional cavity has a progressive increase in its volume, said control conduit means serving to pass liquid propellant at a controlled rate of flow from said first additional cavity to said second additional cavity and thereby control the rate of change of said volumes of said first and second additional cavities.

9. A gun according to claim 1 further including:

a primer disposed in said projectile receiving chamber;

a booster disposed in said projectile receiving chamber;

means for firing said primer, said primer when fired serving to ignite said booster to generate combustion gas;

conduit means for passing booster generated combustion gas to said piston sleeve for driving said piston sleeve to reduce the volume of said pumping chamber.

10. A gun according to claim 1 wherein:

said third conduit means includes a plurality of conduits having their outlets longitudinally spaced apart.

11. A gun according to claim 1 wherein:

said third conduit means includes an annular row, in a transverse plane, of radial bores having their outlet ends opening into means for deflecting a flow through said bores of liquid propellant forwardly along the inner wall of said firing bore.

12. A gun according to claim 1 wherein:

said deflecting means comprises an annular groove formed in said inner wall of said firing bore and having an aft shoulder projecting partially into the passageway of each of said bores and a forward face sloping into said inner wall of said firing bore.

13. A gun according to claim 1 wherein:

said obturating means includes a gun bolt an annular seal extending between said gun bolt and said aft end of said projectile receiving chamber.

14. A gun according to claim 13 wherein:

said annular seal is a cartridge case.

15. A gun according to claim 13 further including:

a primer carried by said annular seal and disposed in said projectile receiving chamber;

a booster carried by said annular seal and disposed in said projectile receiving chamber;

means for firing said primer, said primer when fired serving to ignite said booster to regenerate combustion gas;

conduit means for passing booster generated combustion gas to said piston sleeve for driving said piston sleeve to reduce the volume of said pumping chamber.

16. A gun according to claim 1 wherein:

said piston sleeve has a first transverse face adjacent to said pumping chamber of a first cross-sectional area, and a second transverse face remote from said pumping chamber of a second cross-sectional area, said second area being greater than said first area.

17. A gun according to claim 16 wherein:

said obturating means includes a gun bolt, and a cartridge case carried by said gun bolt and projecting into said projectile receiving chamber; and further including a primer carried by said cartridge case;

a booster carried by said cartridge case;

means for firing said primer carried by said gun bolt, said primer when fired serving to ignite said booster to generate combustion gas; and conduit means for passing booster generated combustion gas to and against said second transverse face of said piston sleeve for driving said piston sleeve to reduce the volume of said pumping chamber.

18. A gun according to claim 17 further including:

a projectile carried by said cartridge case.

19. A gun according to claim 18 wherein:

said third conduit means includes a plurality of conduits having their outlets longitudinally spaced apart, at least the forwardmost outlet being obturated by said projectile while it is carried by said cartridge case.

20. A gun according to claim 1 wherein:

said piston sleeve travels in a first direction to increase the volume of the pumping chamber under the pressure of inletted liquid propellant, and travels in a second, opposite to said first, direction to decrease the volume of the pumping chamber under the pressure of combustion gas, and further including control means, coupled to said piston sleeve, for limiting the velocity of said piston sleeve in said first direction.

21. A gun according to claim 20 wherein:

said gun has a cycle of operation;

said travel of said piston sleeve in said first direction occurs at a first time in said cycle, said travel of said piston sleeve in said second direction occurs at a second time which is subsequent to said first time, and said control means additionally is for driving said piston sleeve in said second direction at a third, subsequent to said second, time in said cycle, if and only if, said piston sleeve has not traveled in said second direction prior to said third time.

22. A gun according to claim 21 further including:

conduit means coupled to said pumping chamber for discharging liquid propellant from said pumping chamber if and when said control means drives said piston sleeve in said second direction.

23. A gun according to claim 21 wherein:

said control means includes a timing cam driven by said gun, and a cam follower coupled to said piston sleeve.

24. A gun according to claim 23 wherein:

said timing cam is a cam track in which said follower rides and is thereby provided with a positive rectilinear displacement with respect to time in said gun cycle, and said piston sleeve normally undergoes a positive rectilinear displacement with respect to time, and further including clutch means coupled to an between said piston sleeve and said follower and engaged at a predetermined mutual relationship of said piston sleeve and said follower.

25. A liquid propellant gun comprising:

a combustion chamber extending longitudinally into the firing bore of a gun barrel;

a first conduit outlet means for providing liquid propellant into said combustion chamber;

means for igniting liquid propellant from said first conduit outlet means to provide a longitudinally forward flow of combustion gas through said combustion chamber and firing bore; and a second conduit outlet means, longitudinally forward of said first conduit outlet means, for providing liquid propellant into said combustion chamber including means in conjunction with said flow of combustion gas for deflecting the flow of liquid propellant longitudinally forwardly as a surface film along the inner wall of said combustion chamber and firing bore.

26. A liquid propellant gun comprising:

a gun barrel fixed to said housing having a firing bore with a projectile receiving chamber disposed along a longitudinal axis;

a valve sleeve of substantially annular, longitudinally extending shape coaxial with said barrel longitudinal axis;

a piston sleeve of substantially annular, longitudinally extending shape coaxial with said barrel longitudinal axis;

means for supplying liquid propellant;

conduit means for passing liquid propellant from said supply means into said firing bore;

said valve sleeve serving to open and close said conduit means;

said piston sleeve serving to pass liquid propellant through said conduit means when it is open.

27. A gun according to claim 26 wherein:

said conduit means includes a plurality of longitudinally spaced apart conduits each for passing liquid propellant to longitudinally spaced apart portions of said firing bore;

said valve sleeve serving to initially close all of said conduits and to subsequently open said conduits in sequence, the aftmost conduit first and the forwardmost conduit last.

28. A liquid propellant gun according to claim 26 wherein:

said piston sleeve is a differential piston having a longitudinally extending medial portion integral with a first transverse annular portion at one end thereof and a second transverse annular portion at the other end thereof, said first portion having a transverse surface for displacing liquid propellant through said conduit means, and an interior peripheral surface for journaling said piston for longitudinal movement, said second portion having an interior peripheral surface and an exterior peripheral surface for journaling said piston for longitudinal movement.

29. A gun comprising:

a gun barrel having a firing bore, having an aft end and a forward end, for guiding a projectile;

a first chamber for generating combustion gas coupled to the aft end of said firing bore to provide initial acceleration to a projectile disposed in said firing bore; and a projectile velocity assistance mechanism coupled to said firing bore;

said projectile velocity assistance mechanism comprising:

a housing secured to said gun barrel;

injector means, for injecting liquid propellant into said firing bore of said gun barrel, disposed in said housing, including:

a cavity in housing;

a piston, disposed in said cavity to divide said cavity into a liquid propellant receiving chamber and a combustion receiving chamber, and slidably mounted for movement to and between a first and a second position;

a first conduit means in fluid communication between (i) said firing bore at a first point along said firing bore which is forward of said aft end whereat said first chamber is coupled, and (ii) said combustion gas receiving chamber;

a second conduit means in fluid communication between (i) said firing bore at a second point along said firing firing bore which is forward of said first point, and (ii) said liquid propellant receiving chamber;

a liquid propellant supply under pressure in fluid communication with said liquid propellant receiving chamber;

valve means controlling said second conduit means and normally biased to close said second conduit means against the pressure of said liquid propellant supply;

said valve means constructed to open under increased pressure in said liquid propellant receiving chamber caused by combustion gas passing from said first chamber, into said firing bore, through said first conduit means, into said combustion gas receiving chamber to apply pressure against said piston to increase the volume of said gas receiving chamber and to decrease the volume of said liquid propellant receiving chamber;

whereby liquid propellant flows from said liquid propellant receiving chamber, through said second conduit means, into said firing bore, aft of the previously accelerated projectile, and ignites to provide additional combustion gas to provide subsequent acceleration to the projectile before it exits the forward end of the firing bore.

* * * * *